US008545315B2

(12) United States Patent
Mosley et al.

(10) Patent No.: US 8,545,315 B2
(45) Date of Patent: Oct. 1, 2013

(54) GAMING SYSTEM AND METHOD

(75) Inventors: Bob Mosley, Piedmont, SC (US); Troy Jungmann, Austin, TX (US)

(73) Assignee: Gateway Gaming, LLC, Piedmont, SC (US)

( * ) Notice: Subject to any disclaimer, the term of this patent is extended or adjusted under 35 U.S.C. 154(b) by 0 days.

(21) Appl. No.: 13/424,630

(22) Filed: Mar. 20, 2012

(65) Prior Publication Data

US 2012/0214600 A1 Aug. 23, 2012

Related U.S. Application Data

(60) Provisional application No. 61/566,653, filed on Dec. 4, 2011.

(51) Int. Cl.
*A63F 9/24* (2006.01)

(52) U.S. Cl.
USPC ..... 463/25; 463/28; 463/42

(58) Field of Classification Search
USPC ..... 463/16, 20, 25, 40–42, 28
See application file for complete search history.

(56) References Cited

U.S. PATENT DOCUMENTS 5,280,909 A * 1/1994 Tracy ..... 463/27
5,779,546 A * 7/1998 Meissner et al. ..... 463/25
6,110,043 A * 8/2000 Olsen ..... 463/27
6,319,125 B1 * 11/2001 Acres ..... 463/25
6,345,824 B1 * 2/2002 Selitzky ..... 273/292
6,475,088 B1 * 11/2002 Jones et al. ..... 463/27
6,780,105 B1 * 8/2004 Kaminkow ..... 463/16
6,887,154 B1 * 5/2005 Luciano et al. ..... 463/26
6,988,946 B2 * 1/2006 Michaelson et al. ..... 463/17
7,169,041 B2 * 1/2007 Tessmer et al. ..... 463/16
7,311,598 B2 * 12/2007 Kaminkow et al. ..... 463/16
7,416,484 B1 * 8/2008 Nelson et al. ..... 463/25
7,419,162 B2 * 9/2008 Lancaster et al. ..... 273/292
7,736,223 B2 6/2010 Pace
7,892,085 B2 2/2011 Harris
8,070,589 B2 12/2011 Macke
2003/0104853 A1 * 6/2003 Tessmer et al. ..... 463/16
2004/0147321 A1 * 7/2004 Duhamel ..... 463/42
2005/0187014 A1 * 8/2005 Saffari et al. ..... 463/27
2005/0239537 A1 * 10/2005 Ogiwara ..... 463/17
2006/0121971 A1 * 6/2006 Slomiany et al. ..... 463/16
2007/0060247 A1 * 3/2007 Low et al. ..... 463/16
2007/0082725 A1 * 4/2007 Low et al. ..... 463/16
2008/0188288 A1 8/2008 Seelig et al.
2008/0207301 A1 * 8/2008 Yokota et al. ..... 463/17
2008/0214294 A1 * 9/2008 Yoshizawa ..... 463/25

(Continued)

*Primary Examiner* — William Brewster
*Assistant Examiner* — Jason Skaarup
(74) *Attorney, Agent, or Firm* — Sutherland Asbill & Brennan LLP

(57) ABSTRACT

A player accesses a game terminal, which is networked to other game terminals configured to play standard games and game-in-games. The player initiates a standard game (e.g., lottery slot) on the game terminal. The game terminal receives a game initiation request for the standard game and starts a timer. Prior to expiration of the timer, the player may perform a predefined action (e.g., pressing a spin button) indicating that the player wishes to play a game-in-game (e.g., a "community prize" game). If the timer expires without the player performing the predefined action, (s)he is deemed ineligible to win an award associated with the game-in-game. However, in response to player performing the predefined action prior to the timer's expiration, the player is deemed eligible to win an award associated with the game-in-game, and the player participates in both the game and the game-in-game.

25 Claims, 9 Drawing Sheets

(56) References Cited

U.S. PATENT DOCUMENTS

| | | | | |
|---|---|---|---|---|
| 2008/0274783 | A1* | 11/2008 | Walker et al. | 463/13 |
| 2008/0305856 | A1* | 12/2008 | Walker et al. | 463/25 |
| 2009/0011833 | A1 | 1/2009 | Seelig et al. | |
| 2009/0104991 | A1 | 4/2009 | Seelig et al. | |
| 2009/0111572 | A1* | 4/2009 | Bigelow et al. | 463/21 |
| 2009/0117984 | A1 | 5/2009 | Seelig et al. | |
| 2009/0124371 | A1* | 5/2009 | Gilmore et al. | 463/27 |
| 2009/0137313 | A1* | 5/2009 | Young | 463/31 |
| 2009/0239622 | A1* | 9/2009 | Fujimori et al. | 463/20 |
| 2009/0239625 | A1* | 9/2009 | Yoshizawa | 463/20 |
| 2010/0062820 | A1* | 3/2010 | Yoshizawa | 463/11 |
| 2010/0120494 | A1* | 5/2010 | DeWaal et al. | 463/20 |
| 2010/0124988 | A1* | 5/2010 | Amos et al. | 463/27 |
| 2010/0285860 | A1* | 11/2010 | Svanas | 463/20 |
| 2012/0034968 | A1* | 2/2012 | Watkins et al. | 463/20 |
| 2012/0077569 | A1* | 3/2012 | Watkins et al. | 463/25 |
| 2012/0077579 | A1* | 3/2012 | Apirian et al. | 463/29 |
| 2012/0077587 | A1* | 3/2012 | Apirian et al. | 463/31 |
| 2012/0077588 | A1* | 3/2012 | Apirian et al. | 463/31 |

* cited by examiner

[601-1] Attract Mode

[601-2] Ready Mode

[601-3] Spin Mode 1

[601-4] Spin Mode 2

[601-5] Winner Mode

GAMING SYSTEM AND METHOD

CROSS-REFERENCE TO RELATED APPLICATIONS

This application claims benefit of priority under 35 U.S.C. §119(e) to the filing date of U.S. Provisional Application No. 61/566,653, as filed on Dec. 4, 2011, which is incorporated herein by reference in its entirety.

FIELD OF THE INVENTION

The present invention relates generally to gaming systems and, more particularly, to a gaming system and method that allows a player to engage in two games at once with a possible reward for each of the two games.

SUMMARY OF THE INVENTION

Embodiments of the present invention recognize and address the foregoing considerations, and others, of prior art construction and methods.

In this regard, one aspect of the present invention provides a method of playing a game-within-a-game (i.e., playing a game on a first game terminal while another game is being played on the same terminal by the same player). This game-in-game is played by a plurality of game terminals at the same time, where the game terminals are all linked together over a network. In this regard, each player provides an indication to play a standard game on each respective gaming terminal, such as by pressing a spin button. The player is then given an option to play the game-in-game. Each player then spins within the predefined time and such spin plays both the game and the game-in-game (referred to herein as a "community prize game"). A server is connected via a network to each gaming terminal. Each gaming terminal, if so elected by the player, may be included in the community prize game. A predetermined number of "spins" or plays of the game-in-game, as an aggregate number by all of the linked game terminals, is set. When the server determines that the predetermined number of spins has been reached, a community prize winnings round is initiated to determine who the winners are, and the winners are selected based on those who were playing the game-in-game at the time of the initiation of the community prize winnings round. Regardless of a winner or a loser for the community prize winnings round, the community prize game "spins" and displays the appropriate result.

According to another embodiment of the present invention, a method is provided including providing a plurality of gaming terminals linked together via a network. An indication that a first player desires to play a first game is received from a first gaming terminal. The first player also provides an indication from the first gaming terminal that the first player desires to play a first game-in-game. The first game-in-game is played at the same time the first game is played. An indication that a second player desires to play a game is received from a second gaming terminal. The second player also indicates, from the second gaming terminal, that the second player desires to play a second game-in-game. The second game-in-game is played at the same time the second game is played. This scheme may be repeated for each additional player at each additional gaming terminal. During at least a portion of the standard game being played on any game terminal, a community prize game is initiated by initiating a communities winnings round that generates a prize for the players who are eligible or a random winner is selected to receive the bottom tier prize.

According to another embodiment of the present invention, a method is provided. A first player accesses a game terminal, wherein the game terminal is networked to other game terminals configured to play games and game-in-games. The player sends a game initiation request for a standard game (e.g., lottery slot) to be played on the game terminal. A timer is started in response to receiving a game initiation request. Prior to the timer timing out, the first player may perform a predefined action (e.g., pressing the spin button) indicating that the player wishes to play a game-in-game (community prize game). In response to the timer timing out, the player is not eligible to win an award associated with the game-in-game, and the player may then play the standard game. However, in response to the player performing the predefined action prior to the timer timing out, the player is eligible to win an award associated with the game-in-game, and the player plays both the game and the game-in-game.

According to another embodiment, a method includes allowing a first player to access a first game terminal which is networked with other game terminals. A first game initiation request is received for a first game to be played on the first game terminal. If the first player performs a predefined action indicating that the first player wishes to play a first game-in-game, the first player is eligible to play the first game-in-game, and the first player plays both the first game and the first game-in-game. If the first player does not perform the predefined action, the first player is not eligible to play the first game-in-game, and the first player is not allowed to play the first game.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

DESCRIPTION OF SOME EMBODIMENTS

Embodiments of the present invention support games structured for all game styles known in the art. In some embodiments, the present games and methods can be used in connection with any and all Class II and III games. In yet another embodiment, the present games and methods can be used in connection with Class III random number generated ("RNG") games, Class III electronic pull tab games, electronic bingo games, lottery-based games, and sweepstakes games. Embodiments of the invention are agnostic to the methods in which the results are delivered.

a. Overview

As previously mentioned, a game-in-game relates to a player playing a standard game on a game terminal while another game is being played. This allows the player to play multiple games at the same time and is an enjoyable experience for the player.

The community prize game of the invention is a game-in-game. In this regard, according to an embodiment, the community prize game is a game that is linked with a plurality of other game terminals such that when the community game is being played as a game-in-game for multiple game terminals, the players of the community game are eligible to win a common shared prize (or separate prizes for each game terminal) between all game terminals.

In one embodiment, the player may purchase internet time or another product or service, and when this occurs, the player may be issued participation credits to play the game and game-in-game. In an embodiment, a particular amount of participation credit allows the player to play one round of the standard game and community prize game.

In some embodiments, the player may pay a fee to play the standard game and the game-in-game. For example, a player pays a first fee, such as $0.25, to play the standard game (e.g., a slot game) and at the same time pays an additional contribution fee, such as $0.02, to play the community prize game. The players thus each pay $0.27 to play the standard game, which also enters the player into the community game (and thus, makes the player eligible for the community prize winnings round).

More detailed descriptions are provided below according to some embodiments.

b. System

Figure 1:
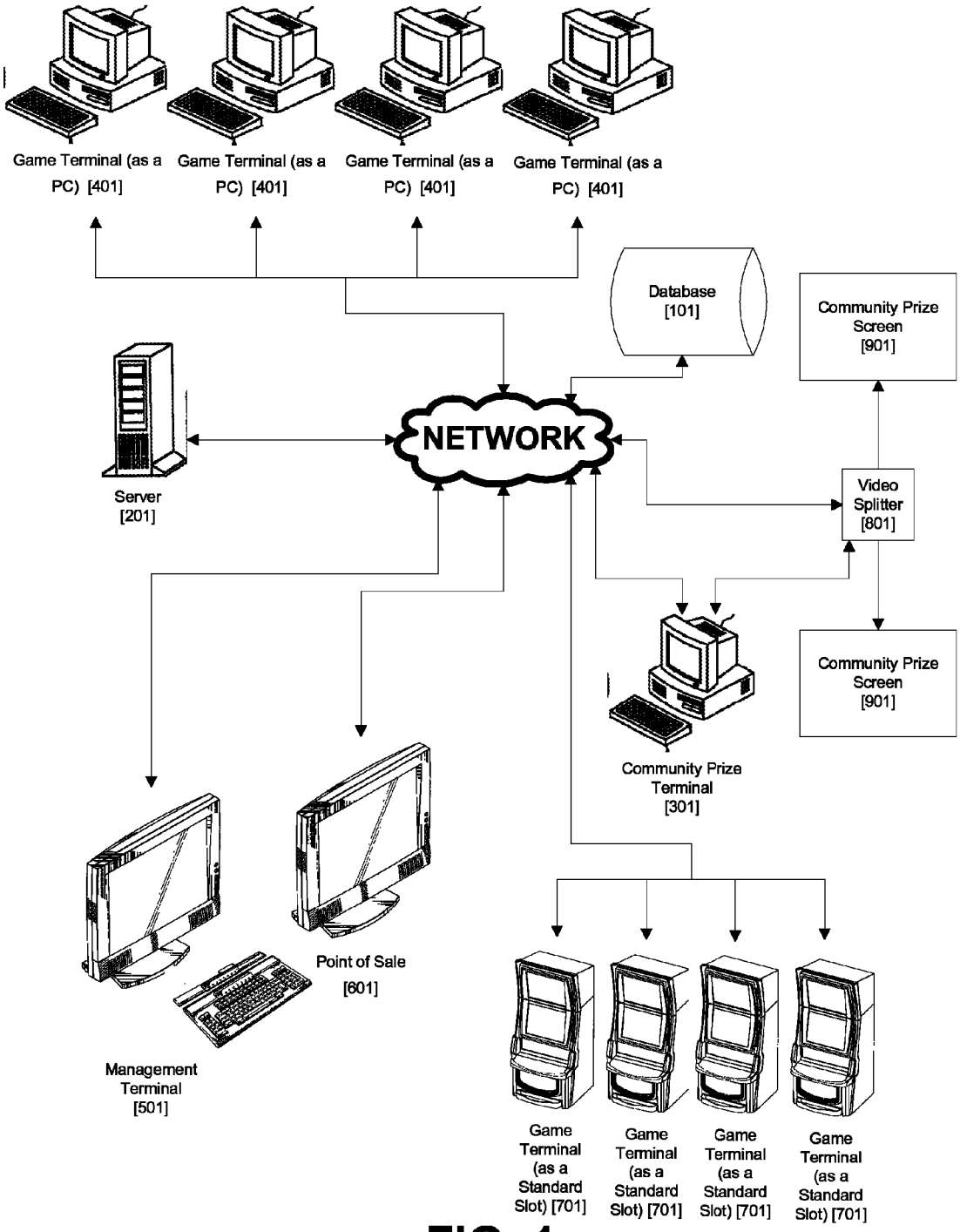
FIG. 1 is a view perspective of an exemplary floor configuration that provides a foundation of a community prize in accordance with an embodiment of the present invention.

FIG. 1 illustrates a system 100 for providing a community prize game in accordance with an embodiment of the present invention. The system 100 may include a database 101, a server 201, at least one game-in-game ("GNG") terminal 301, one or more game terminals (that may be PC-based) 401, a management terminal 501, a point-of-sale device ("POS") 601, one or more standalone game terminals (that may be any gaming-based machine) 701, a video splitter 801, a relatively large monitor or television 901, or any combination thereof. Those skilled in the art should appreciate that other configurations may be used to accomplish the methods described herein without departing from the scope of the present invention.

It should be understood that each of the computing devices, including the server 201, at least one game-in-game ("GNG") terminal 301 (also referred to herein as the "community prize terminal"), one or more game terminals (that may be PC-based) 401, a management terminal 501, a point-of-sale device ("POS") 601, and one or more standalone game terminals 701, may each have a computer hardware processor, input and output devices (e.g., a computer monitor, a keyboard, selection buttons, and/or mouse) and at least one storage device (e.g., memory, hard drives, etc.). These devices may also have network connection cards to connect to the network. At least some of these devices may also include a computer readable medium, which is described later.

The community prize game comprises a game-within-a-game system and may run asynchronously with an integrated gaming system or as a linked product via SAS to other gaming terminals or terminals. in certain embodiments, the community prize game is not intended to be a standalone gaming platform because it is initiated based upon play of the standard game on each gaming terminal connected to the gaming system 100. There are specific integration points between the game server, gaming terminals, and the community prize game that are identified by FIGS. 2A and 2B.

The server 201 is employed to communicate data from various devices in the system and to perform one or more method steps, as detailed below. The database 101 may also be employed in the invention and may contain various types of data and computer instructions for performing at least some of the steps presented herein. Although a single server is indicated for the server 201, and a single database for the database 101, it should be understood that the network may be comprised of multiple servers and databases, whether located locally and networked through a local area network or remotely through a wide area network or an Internet connection. Thus, the single representations at 201 and 101 are provided for purposes of illustration only and should be understood to represent such other configurations.

The gaming terminals 401 and 701 are illustrated as linked or ganged together via a network (which may be via the network shown in FIG. 1 or any additional network). The group of gaming terminals 401 and 701 perform the methods herein by the term "gaming terminal" or "gaming terminals." The gaming terminal may be a standard standalone gaming machine 701, a personal computer ("PC") 401 or other computing device (not shown). The gaming terminals of 401 and 701 are illustrated in FIG. 1 as separate groups (even though they function similarly and perform the same method steps) because some jurisdictions do not allow gaming machines but do allow personal computers (the gaming terminal 401 is illustrated in FIG. 1 as a personal computer in one embodiment). Thus, in some jurisdictions the gaming terminals are personal computers 401 and other jurisdictions are gaming machines 701.

Figure 4:
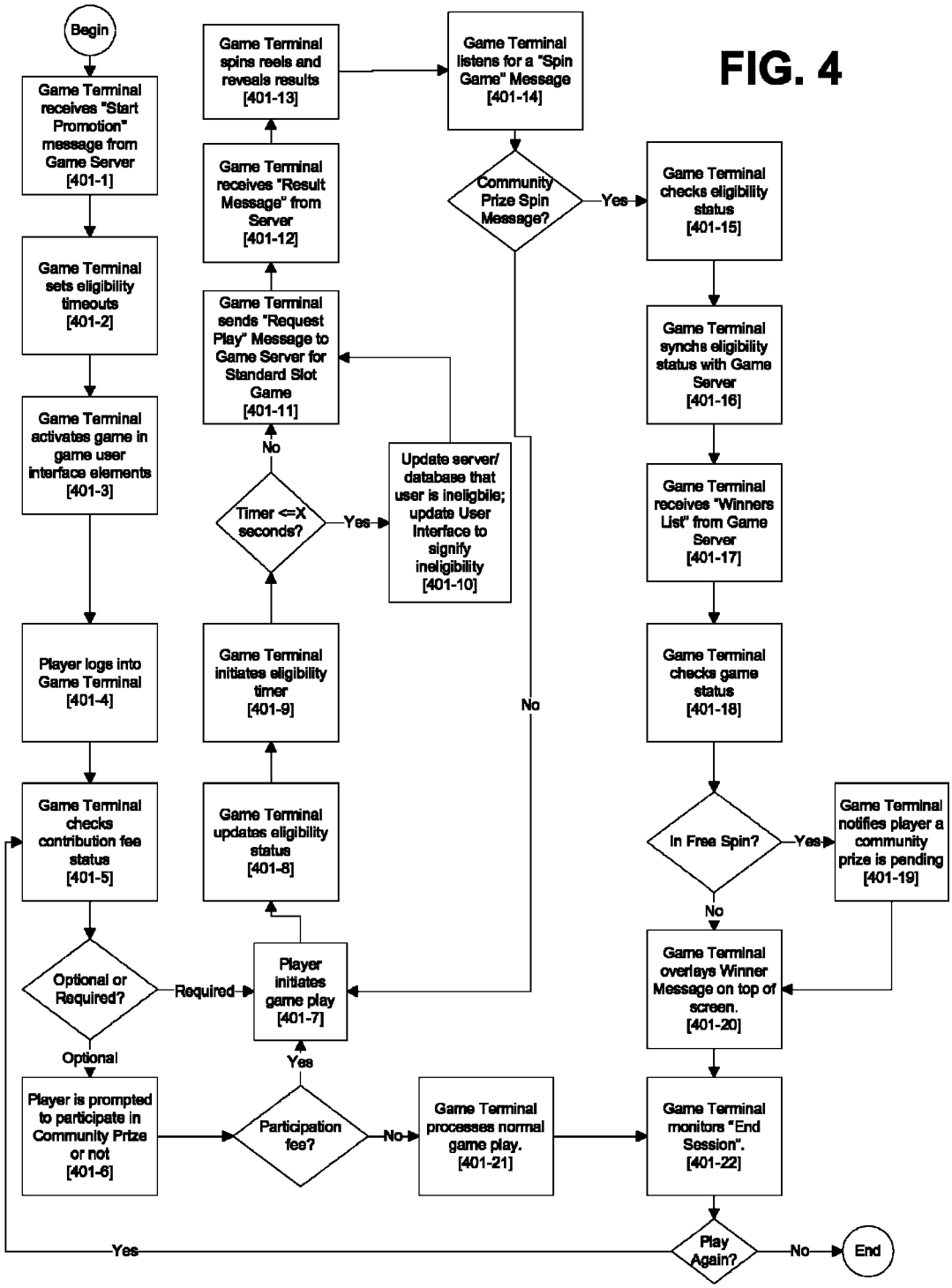
FIG. 4 is a sequence diagram illustrating an exemplary process performed by one of the game terminals of FIG. 1 to carry out a community prize game in accordance with an embodiment of the present invention.

Nonetheless, each gaming terminal 401, 701 may perform the method steps of FIG. 4 and interface with the player of the games and the game-in-game. For example, the games may begin when the player depresses or activates the spin button on the gaming terminal 401, 701, whether the gaming terminal is a standard gaming machine 701 or a personal computer 401.

The point of sale 601 device is a device where players can buy internet time or some other product or service, and play of the gaming terminals could be free with such purchases. In one embodiment, the player may use the point of sale device 601 to directly load an account card with credits to play games on the gaming terminals. This account card is associated with an account that the player may use to play the game and game-in-game on a game terminal (and especially if the game terminal is a gaming machine 701).

The management terminal 501 may be a device that is connected with the server 201 to initiate, enable, disable or change the community prize game, as will be discussed later. Other managerial or supervisory operations may also be performed using the management terminal 501.

The community prize terminal 301 controls one or more operations of the community prize, such as determining results for the community prize game, displaying the community prize game results, and/or any other operations as discussed herein. In some embodiments, the community prize terminal 301 is part of the server 201 such that the server 201 performs all or part of the operations of the community prize terminal 301. Operations of the community prize terminal 301 are discussed later with regard to FIG. 3.

A video splitter 801 may be connected to the community prize terminal 301 and/or the network. The video splitter may be used to split any received video feed to multiple community prize screens 901. The community prize screens 901 may be television screens, monitors or other device that displays the community prize game board and other procedures of the community prize.

One or more of the devices illustrated in FIG. 1 may be connected to a network as previously mentioned. In one embodiment, all devices in FIG. 1 are connected to the network and communicate with each over the network. It should be noted that the network in FIG. 1 need not be a single network (such as just the internet) and may be multiple networks (whether connected to each other or not). For example, the network may be the internet. In another example, the network may be a local area network ("LAN") and a wide area network ("WAN") (e.g., the Internet) such that one or more devices (e.g., server 201, community prize terminal 301, management terminal 501, database 101) are connected together via the LAN and the LAN is then connected to the WAN which in turn is connected to other devices (e.g., the game terminals 401, 701). It should be understood that any number of game terminals (401, 701) may be connected to the network (whether the network is a LAN or WAN) so that a plurality (or all) of the game terminals 401, 701 are linked together on the network. It should further be understood that a first group of game terminals 401, 701 may be linked together on a network while a second group of game terminals 401, 701 are linked together. The terms "linked together" or "connected together" refers to devices having a common network connection via a network (either directly on a network or indirectly through multiple networks), such as one or more devices on the same LAN, WAN or some network combination thereof.

It should be understood that FIG. 1 is an exemplary embodiment and various other configurations are within the scope of the present invention. Additionally, it should be understood that additional devices could be included in the system shown in FIG. 1.

d. Methods and Graphical Interfaces

Figure 2A:
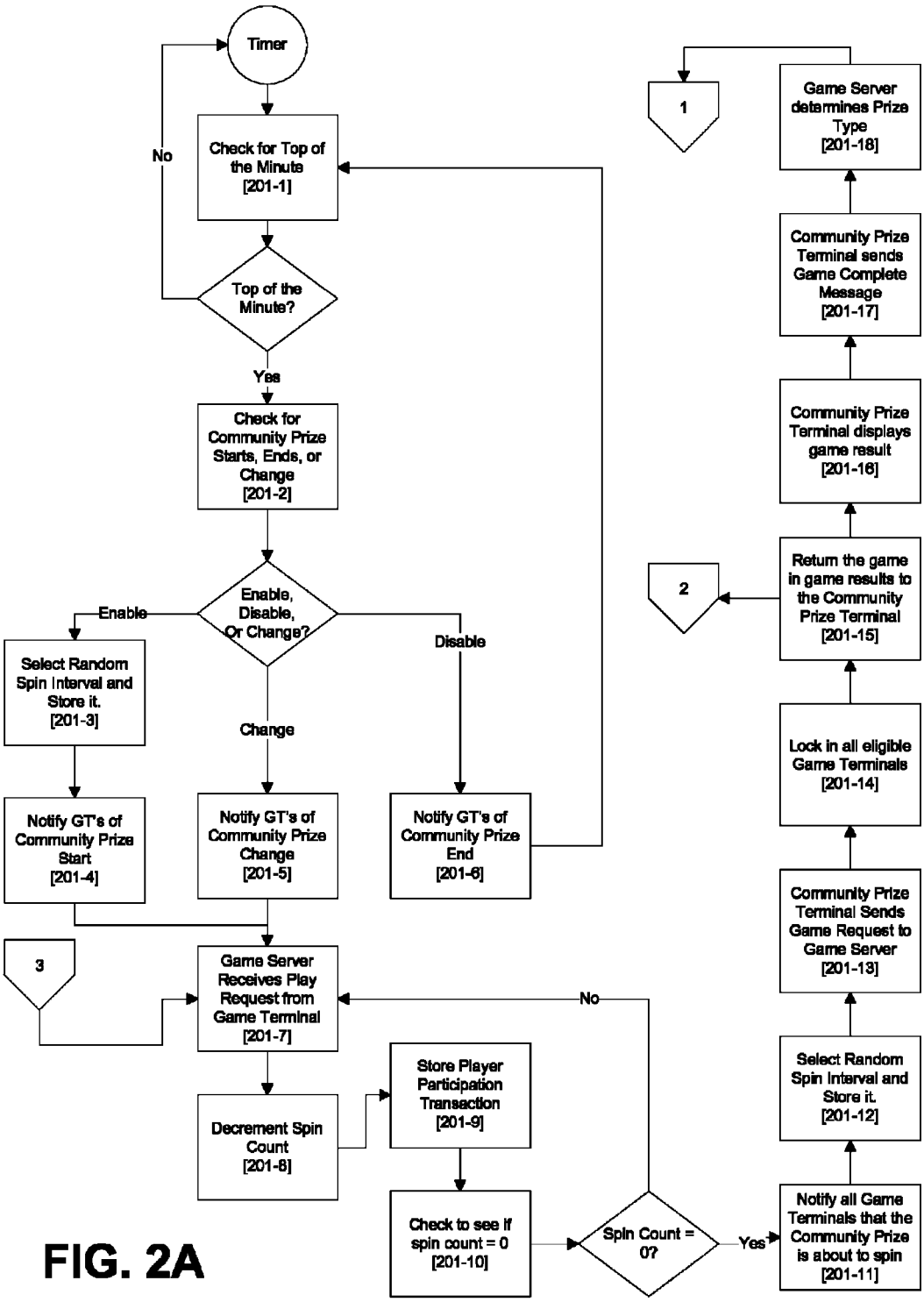
FIGS. 2A and 2B comprise a sequence diagram illustrating an exemplary process performed by the game server of FIG. 1 to carry out a community prize game in accordance with an embodiment of the present invention.
Figure 2B:
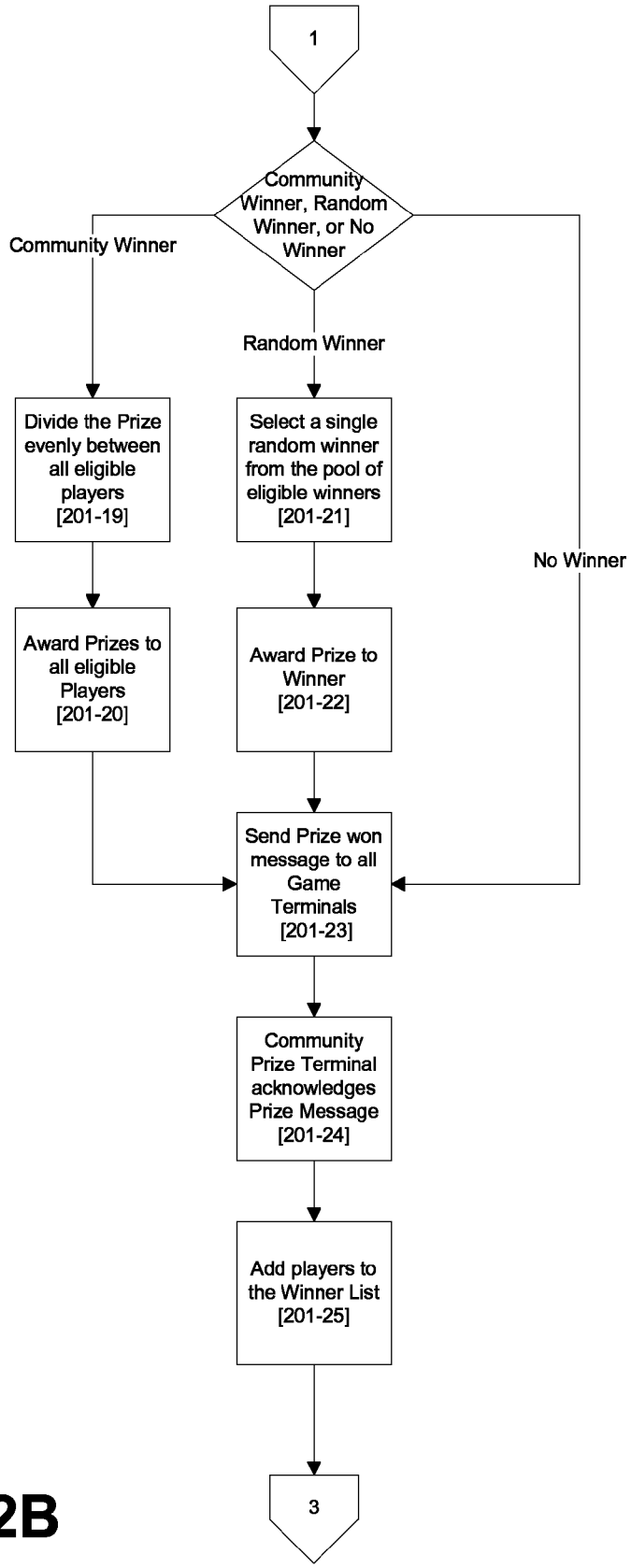

FIGS. 2A and 2B illustrate a block flow diagram illustrating an exemplary process performed by the game server 201 of FIG. 1 to carry out a community prize game in accordance with an embodiment of the present invention. At block 201-1, a timer is initiated at the launch of the community prize game, which is a game-in-game of a first game. The first game may be an electronic game which displays a spinning reel containing combinations of symbols. In this game, the winner may be determined based upon whether a predetermined set of combinations are displayed. The game-in-game (or "community prize game" as referred to herein) is a game that is played simultaneously while the first game is being played and is played on the same game terminal by the same player using the same or different account. The community prize game is discussed in more detail below.

In an embodiment, at the top of the minute, a timer initiates step 201-2. If step 201-2 is not initiated, the timer may sleep until the top of the next minute. This ensures that, in an embodiment, the community prize game starts at the top of the minute. It is understood that the timer may initiate the game at any predetermined intervals.

Step 201-2 may be initiated from process 201-1 when a new community prize promotion is initiated. A new community prize promotion relates to the initiation of the community prize game or a replaying of the community prize game. The process accesses database 101 determines if a community prize promotion starts, changes, or ends. If none of the cases are met, the method may proceed to step 201-7. Otherwise, the method may proceed to steps 201-3, 201-5, and 201-6, respectively, as described in more detail below.

Step 201-3 is initiated upon success of step 201-2, and the server (or game terminal) selects a single random number that is used to determine when the next game-in-game activation will occur. The random number is selected within a user-defined range consisting of a minimum spin and a maximum spin count. A spin count is defined as an aggregate of the number of physical reel spins of all participating game terminals that occur since the beginning of a promotion or since the last community prize was awarded. This spin number will determine when the community prize winning round will be initiated, and the community prize winning round is discussed later. A spin range is used to make the promotion unpredictable and more interesting to the players since the spin number can be high or very low, making when the community prize winning round occurs even more variable. Nonetheless, the frequency of spin of the community prize game is determined by the volume of play occurring on the floor. The spin frequency (e.g., how often the player is required to spin) is determined by average participation fee collected per spin. The term participation fee and contribution fee are synonymous herein and relate to a fee or credit required to play the game and/or game-in-game.

Step 201-4 may be initiated upon success of process 201-3. Upon initiation of the game-in-game functionality, game server 201 notifies each game terminal ("GT") connected to the system via a message sent from the gaming server to the gaming terminals via TCP/IP direct connections or broadcast. The game then changes game terminal player interface configuration as explained below with reference to FIG. 4. The community prize terminal is also notified of the initiation of the game-in-game functionality as explained in more detail below with respect to FIG. 3.

Step 201-5 is initiated from process 201-2 when a change in the game-in-game configuration is determined. The game terminals are notified of any change in the configuration via TCP/IP connection or broadcast. Configuration changes can include a change to date of the promotion, max. and min. spin speeds, community prizes accumulators, contribution values or fees, the base values of any of the community prizes or any other change in the community prize game. Game terminals 401 cache the information and may make graphical adjustments to the contribution value or fee which is displayed.

Step 201-6 is initiated from step 201-2 when the game-in-game functionality is disabled. The game-in-game can be enabled and disabled based on a date range entered via management terminal 501. This process notifies all game terminals via TCP/IP connection or broadcast that the game-in-game functionality is now disabled. The game terminal will disable all game-in-game functionality, as described in more detail with respect to FIG. 4.

Step 201-7 initiates upon completion of step 201-2 and processes associated therewith. As used herein, the term "standard game" or "first game" refers to a game that is presented to the player on the game terminal that the player can play independent of the player playing any other game, according to one embodiment. For example, the standard game may be slots, bingo, and the like on the game terminal. The player may play only this game or may play both the standard game and the game-in-game (e.g., community prize game). Thus, the standard game may be separate from and independent of the game-in-game since the standard game can be played without the game-in-game being played.

Nonetheless, when the player desires to play the standard game on the player's game terminal, the player may initiate the standard game by submitting an initiation request to the server or the game terminal. The initiation request may be the player activating a start button (also referred to herein as a "spin button") or by other means to start the game. Additionally, the player is presented with notification to play the community prize game at the same time as the standard game if the player acts within a predetermined amount of time (this option may be limited by a timer as discussed later and illustrated in FIG. 5). If the player just wants to play the standard game, the player waits until the community prize timer expires (as will be discussed later). Otherwise, the player can activate the start button (mentioned above) before the community game timer expires, indicating that the player wants to play the game-in-game while also playing the standard game (on the same game terminal). The single spin will then play both the standard game and the game-in-game. After activating the start button (or other initiation means), a play message is sent to the server indicating that the game-in-game should be initiated, which players are playing the game-in-game (in addition to the standard game), and that each of these players are eligible for winning a prize if the community prize winning round is initiated. The players that do not play the game-in-game by the time the community prize game timer times out may be allowed to only play the standard game and thus, are not eligible for any prizes should the community game winning round initiate during that game.

In response to initiating the game-in-game in addition to the standard game, the play message is sent to game server 201. The game server 201 receives the delivery of the play message from the game terminal to play the game-in-game. This occurs for each game terminal that is linked together because a plurality of game terminals has players playing the game-in-game at the same time. For each of these players, they are playing the standard game and are activating the game-in-game during the standard game initiation (or while the standard game is being played). The game server receives the play request from the game terminals via TCP/IP or game poll used in the SAS system.

Figure 5:
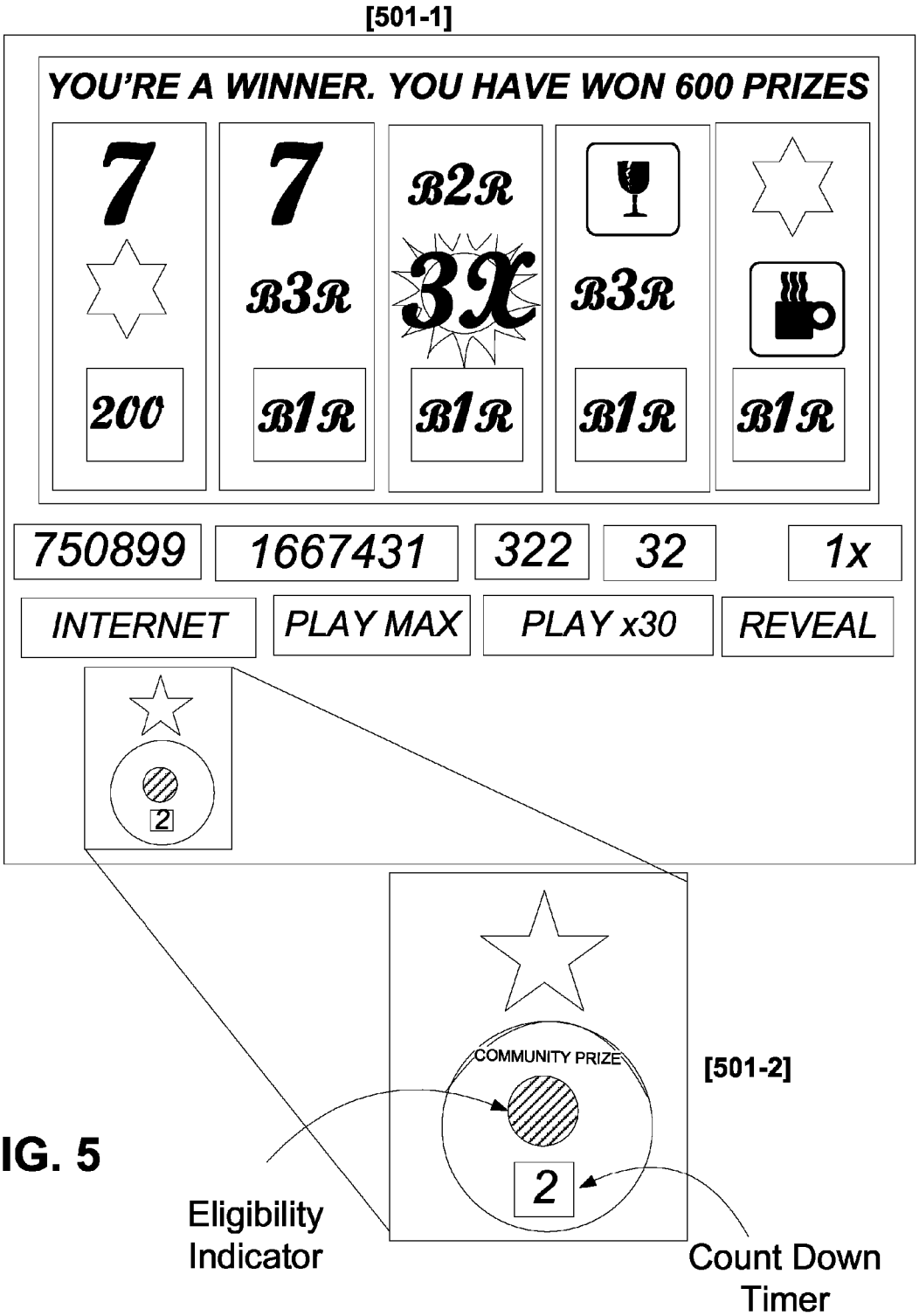
FIGS. 5, 6A, 6B, and 6C illustrate exemplary graphical user interfaces ("GUIs") for a community prize game in accordance with various embodiments of the present invention.

After the play request or initiation request is received, the game server returns the appropriate standard game result (e.g., RNG, bingo or lottery result) to the game terminal and stores the associated gaming transactions in the database. In a SAS implementation, the game itself executes the RNG and determines the standard game results. An example of step 201-7 is shown in FIG. 5. A five reel electronic slot game is shown and the player presses a start button (called a "Reveal" button in FIG. 5), whereby the game reel spins and displays the results as shown in the Figure. This happens for a plurality of game terminals, for a plurality of respective players at the game terminals, so that the game terminals are spinning and playing the standard games for the players. And thus, the game server is receiving the play requests which are messages indicating spins (or each play) of the games on the game terminals. It is noted that FIG. 5 also shows an eligibility indicator which indicates that the player is playing the community prize game and thus, is eligible to win the community prize game.

Referring back to FIG. 2A, step 201-8 initiates upon completion of the game server receiving data regarding the spins for the game terminals linked together at step 201-7. As mentioned above with respect to step 201-3, the game has already randomly selected a spin count whereby the community prize winnings round will execute when the spin count has been reached. The game server simply decrements the spin count by one spin for each game play request that is received from any of the linked game terminals as long as the players are playing the game-in-game.

Step 201-9 initiates upon completion of step 201-8. System 100 stores the players' participation data to the database 101. Each player's participation data may correspond to which players are playing the standard games and which players are additionally playing the game-in-game.

In some embodiments, the players' participation data may correspond to a contribution fee or a dollar amount that each player may pay. In an embodiment, such payment may be accomplished using the game terminals. For example, player pays a first fee, such as $0.25, to play the standard game (e.g., a lottery game) and at the same time pays a "contribution fee," such as $0.02, to play the community prize game or the game-in-game. The players thus each pay $0.27 to spin the wheel for the slot game, which also enters the players into the community game. If the player doesn't pay the contribution fee for the game-in-game prior to the community game timer expiring, the player is not eligible to win any prizes during the community prize winnings round. However, if the player does pay the contribution fee for the game-in game prior to the community prize timer expiring, the player then plays the game-in-game and thus is eligible for the community prize winnings round. The contribution fees for all of the gaming terminals playing the game-in-game may be added to a winnings pool where moneys or awards may be distributed to eligible players from the winnings pool (when the community winnings rounds is played). In an embodiment, the players' contribution fees (which are paid to play the game-in-game) may be distributed among all prize levels by configurable percentages. The community prize game award tiers may have a base value and a percentage of each player's second contribution fee may increase the value of the prize. The random winner prize levels may be funded by the remaining amount of the second contribution fees. The player second contribution fees are used to fund the entire game-in-game prize set. It should be understood that the present invention need not require the players to pay fees to play the standard games and/or the game-in-games.

Step 201-10 initiates upon completion of step 201-9. As explained with respect to step 201-3, a random spin number is selected within a specified spin to spin range and is used to trigger the activation of the game-within-game when the aggregated number of spins of all linked game terminals reaches the predetermined random spin number. To accomplish this, the spin count is set as the random spin number and counts down to zero according to one embodiment. Other embodiments of how to trigger the threshold are within the present invention. This process checks if the spin count is equal to zero which would indicate that the randomly-selected number of spins (discussed in 201-3) has been achieved (and that a winner is about to be determined). If it is not, then the community winnings round will not be played and the player will have to spin again to play the community prize game (to be eligible for the community prize winnings round). The game-in-game therefore awaits the next game play message from each game terminal as described with respect to step 201-7. If the spin count equals zero, then the processes to trigger the game-in-game are activated and the community winnings round is performed and will be discussed below with regard to 201-11 through 201-18.

Step 201-11 initiates upon completion of step 201-10 when the spin count equals zero and thus, the community winnings round begins. Game server 201 notifies all game terminals connected to the system that the game-in-game is about to activate via TCP/IP connection or broadcast. Community prize terminal 301 is also sent a "spin game" message from the game server triggering the game-in-game functionality thereof.

Step 201-12 initiates on completion of step 201-11. A new random number is generated as the random spin number for the next activation. This process functions the same as that described above with respect to step 201-3.

Step 201-13 initiates on completion of step 201-12. Step 201-12 is used to set up the next game-in-game target spin. At this point, the community winnings round portion of the game-in-game has been triggered, and this process sends a community game request to the game server and listens for response from the game terminals. The game-in-game result generation method may be dependent upon jurisdictional regulations. The implementation of the game-in-game system, if functional, may be that which is acceptable in all lottery, bingo, RNG, or other jurisdictions.

Steps 201-14 initiates on completion of steps 201-13. Game server 201 determines which players are eligible to participate in the game-in-game. According to some embodiments, requirements of game eligibility includes: (a) the player chooses to participate by pressing an onscreen button (or providing some indication that the player wants to play the game-in-game) prior to the community timer timing out for the session; and (b) the player spin rate falls into a predetermined time limit such that the player spins within a predetermined time from the commencement of the last spin of the last game (whether the last game was the standard game and/or the game-in-game). The players that do not meet these criteria are ineligible for any prize generated from the community prize winnings round or the community prize game. For example, as illustrated in FIG. 5, the player could have indicated that the player wishes to play community prize but must spin or play the standard game (e.g., the five reel slot game) before the timer runs out. A record identifying why the player is ineligible is written to the database 101. It should be noted that the player need not depress a button indicating that the player wishes to play the game-in-game every time. Instead, an indicator on the screen could just start counting down after the last spin and if the player wants to play community prize game in addition to the standard game, the player may just spin the standard game before the timer runs out.

Nonetheless, all eligible players in 201-14 are locked into the game-in-game community prize winnings round so that any of these players are eligible to win a prize. The community prize winnings round commences and the game plays. The game is shown on a large community prize screen 901 located about the casino, café, or other location. The eligible players then are alerted of the community prize winnings round being played and look up at the community prize screens 901. The community prize screens 901 is where the community prize winnings round is displayed and is an enjoyable experience for the players (however, it should be noted that instead of the community prize screens 901 the community prize winnings round can be displayed on all game terminals or just on the eligible community prize winnings rounds players). The game in the community prize winnings round may be a slot game or any other game where results are displayed and winners are selected.

Step 201-15 may initiate on completion of step 201-14. Game server 201 returns either a winning or losing game result to community prize terminal 301 (and then the results are displayed on the community prize screens 901 as discussed below). The result is generated from either an RNG, pulling a ticket from a lottery prize set, participating in a local electronic bingo game, or any other way to determine winners of a game. Game server 201 stores the prize results data in 101.

Figure 6A:
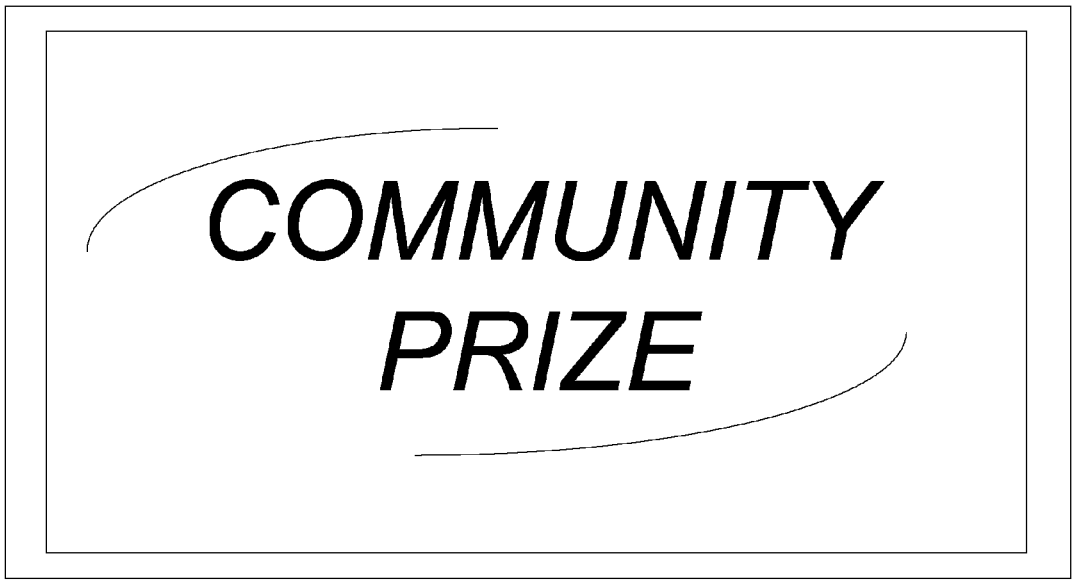
Figure 6A:
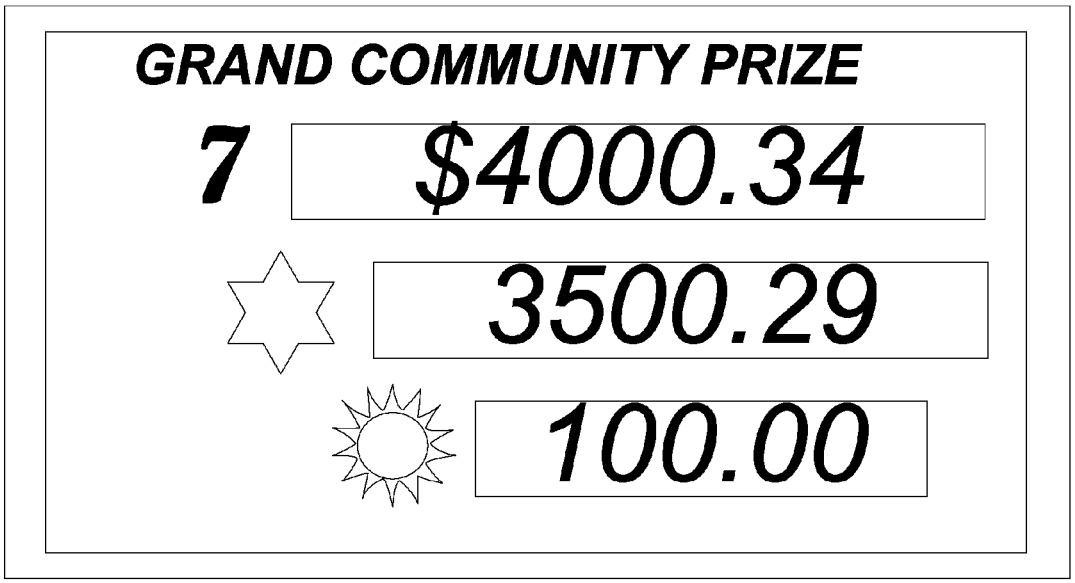
Figure 6B:
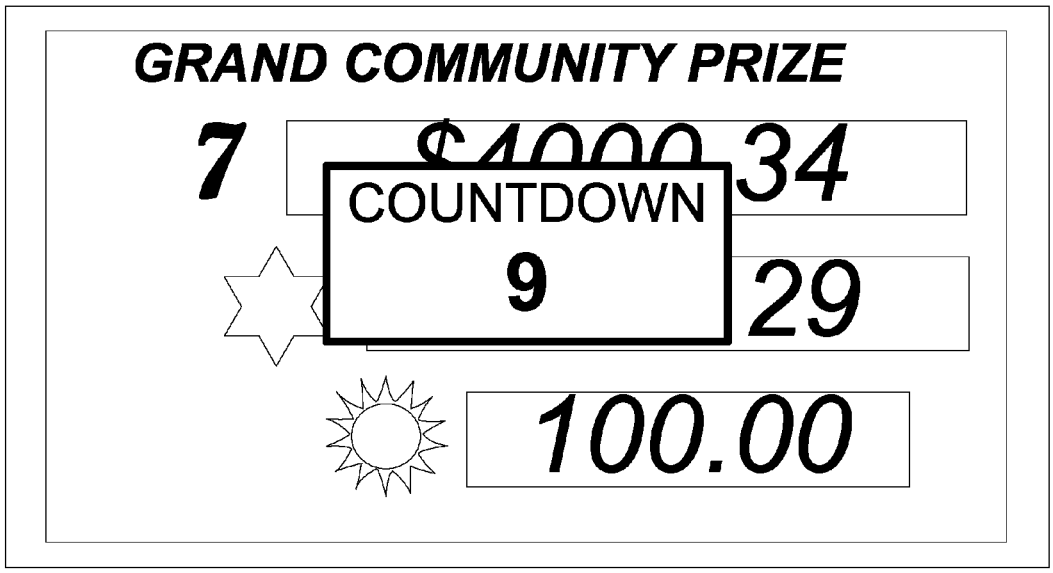
Figure 6B:
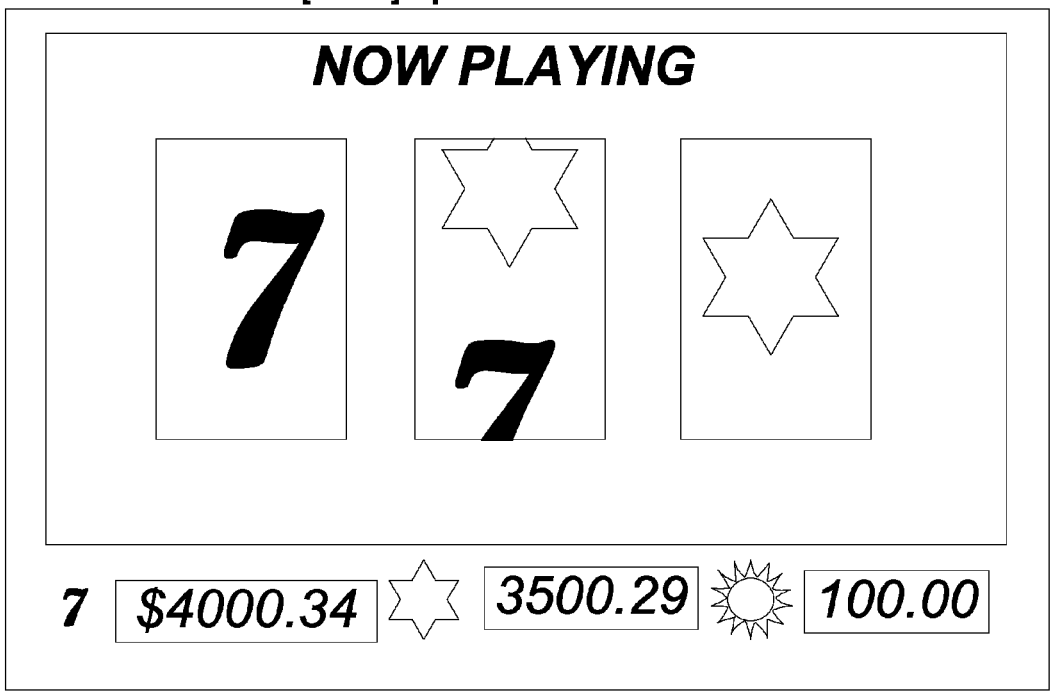
Figure 6C:
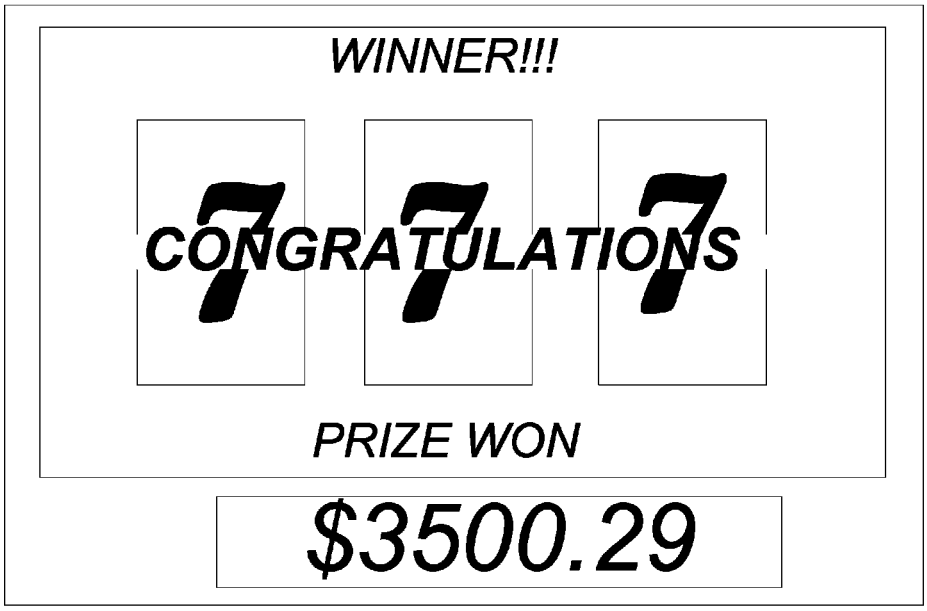

Step 201-16 initiates upon receipt of game result from step 201-15. Community prize terminal 301 matches the prize result returned from the game server to a pattern (e.g., show three reel slot game) that will be displayed on the standalone and wall-mounted community prize screens 901. The game-in-game displays a winning pattern on community prize terminal 301 and community prize screen 901 via commercial video splitter hardware 801. For example, FIG. 6C illustrates a wining result for the community prize winnings round since the displayed symbols of the three reels matched. The game-in-game results contain all graphics that are jurisdictionally required. For example, in a bingo jurisdiction, the game result will be displayed on a bingo card as a winning bingo pattern and may also be accompanied by a three reel game result on the same screen.

Step 201-17 initiates on the completion of step 201-16. Community prize terminal 301 sends a game complete message to the game server signifying that the game-in-game has completed processing which completes the hand-shake between the two processes.

Step 201-18 initiates on the receipt of handshake from step 201-17. Game server 201 determines if the prize result is a winner or a loser. System 100 includes two types of winners: (1) community, and/or (2) a single player random winner. Based upon the type of winner, the system reacts differently as described in more detail below. The community prize game is dynamic because it disseminates between a winning type and a configurable number of prize levels. The community prize game can assign multiple prize levels to each win type. For example, the community prize game can assign the top two prize levels to a community style winner method and assign a contribution percentage to each level, allowing all eligible players to be awarded an equal portion of the prize. Furthermore, multiple prize levels can act as a random winner for different values by changing the configuration of the system.

Step 201-19 initiates on the determination of a type one winner from step 201-18. Game server 201 treats one type of winner as a "community winner." All players who were deemed eligible at step 201-14 are awarded an even amount of a prize (e.g., points, a percentage of the winnings pool, free internet time, a notification that the player is a winner, etc.) based upon the total prize amount divided by the number of eligible players. The prize amount is based on a particular prize level, and, as stated earlier, there can be one to many prize levels per winner type.

Step 201-20 initiates on the determination of a type one winner from step 201-19. Game server 201 awards the prize (e.g., money, internet time, gaming play credits to the players account, etc.) to each individual player account in a cashless implementation or directly to all players' game terminals 701 in a SAS-based or standalone environment. For example, if a player won, the game terminal of that player may receive a monetary credit or the player's account may increase by the prize amount. The associated transactions are stored in database 101.

Step 201-21 initiates on the determination of a random winner step 201-19. Game server 201 uses an RNG to select a single random winner (or a plurality of random winners) for the prize level from the list of eligible players determined at step 201-14. This process triggers on any prize level that is tied to a random winner type.

Step 201-22 initiates on the determination of a type two winner from step 201-19. As discussed above for step 201-20, game server 201 awards the prize to the winner(s). In this regard, a single player account is debited in a cashless implementation or directly to an individual game terminal e.g., 701 in a SAS-based or stand alone environment. The associated transactions are stored in database 101.

If there is no winner, the method continues to 201-23 from the decision block to determine the type of winner.

Step 201-23 may initiate upon successful completion of steps 201-20, 201-22, or a non-winner. All community prize terminals are sent a notification of the prize amount awarded and which game terminals (e.g., 701 or 401) are awarded either the random winner or community type prize(s). The game terminal of the winning players displays a "congratulations" message on the game terminal screen and credits the game. The losing game terminals are also notified of the winners but do not display a message to the player.

Step 201-24 may initiate upon successful completion of step 201-22. Game server 201 sends a game results message to game terminals 701 and 401 and waits for an acknowledgement. This process initiates the acknowledgement and completes the hand shake.

Step 201-25 may initiate upon successful completion of steps 201-24. The game server records all winning accounts (in a cashless environment) or game terminal (e.g. 701 or 401) in a SAS or standalone environment in database 101.

The process then goes back to 201-7. At this point the process starts all over again. The spin for the game-in-game as well as the spin for the standard game is over. Just like spinning slots, the player can then play the games again in the same fashion, and since a random spin number has already been created in block 201-12, this information is accessed and the standard game and the game-in-game is restarted. At this point, the community prize timer restarts and the player has a specific amount of time to spin the standard game and to activate a button (or provide other indication) that the player is playing the community prize game.

Figure 3:
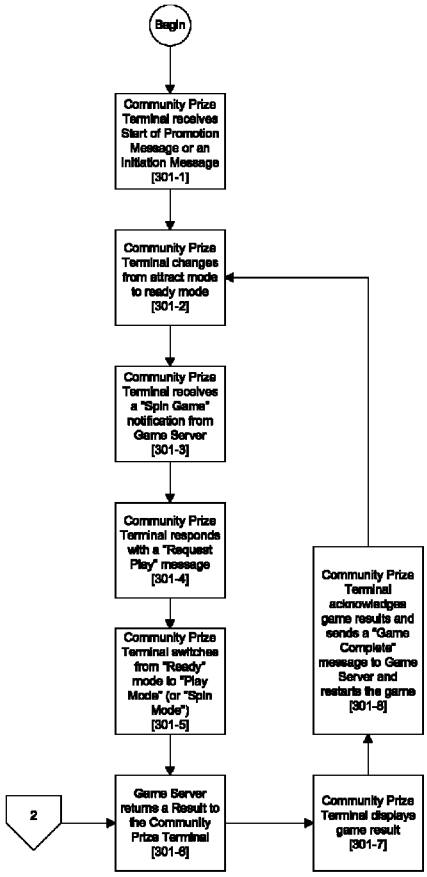
FIG. 3 comprises a sequence diagram illustrating an exemplary process performed by the community prize terminal of FIG. 1 to carry out a community prize game in accordance with an embodiment of the present invention.

FIG. 3 illustrates an exemplary process implemented of setting up the community prize game up at the community prize terminal 301 or the management terminal 501. A manager enables, disables or changes the community prize game from the community prize terminal 301 or the management terminal 501. The community prize game can be set as active (using the community prize terminal 301 or the management terminal 501) based on a timer. For example, if the manager of the community prize game wanted to run the community prize game for only four hours a day, this can be done by the manager enabling or disabling (see 201-2 through 201-6) the community prize game at the community prize terminal 301 or the management terminal 501. The community prize terminal contains software that communicates directly with game server 201. The actual game that is active on the terminal can include a bingo, lottery, or RNG based game and plays exactly like a game connected to the gaming system.

Step 301-1 initiates based on a message from game server 201 described above with respect to step 201-4. Community prize terminal 301 receives a message from the game server identifying the initiation of the game-in-game functionality and configuration parameters of the game. The community prize terminal 301 then sends a message to each of the game terminals linked together (via a network) to enable a means whereby each respective player can activate to start the community prize game. For example, upon receipt of an activation message from the community prize terminal, the game terminals each display a button that, when a player activates (e.g., depresses) the button, the game terminal then is then active to play community prize game (and the player will play the community prize game as long as the player plays the standard game within a predetermined time limit). On the other hand, if the community prize terminal sends a "disable" message to the game terminals, the game terminals in receipt of such message will remove the community prize activation means (e.g., the button) and thus, the players of the game terminals (that received the "disable" message) will not be able to play community prize from the game terminals. In some embodiments, the community prize terminal sends the initiation message or "disable" message to one or more game terminals. In one embodiment, the community prize terminal sends the initiation message or "disable" message to all game terminals.

Step 301-2 may initiate upon successful completion of steps 301-1. When each game terminal is ready to play the community prize game, the community prize terminal 301 changes the game display from attract mode (in block 601-1 in FIG. 6A) to ready mode (in block 601-2 in FIG. 6A) which activates the game functionality. This is the beginning screens of the community prize to catch the players' attention so that the players will play the game-in-game and also to let the players know that the game is ready to be played.

The players then play the community prize game on the game terminals as discussed in FIGS. 2 and 4. When the community prize winnings round is determined to be triggered (e.g., the predetermined, randomized spin count has been reached as discussed previously just prior to step 201-11), the method continues to step 301-3.

It is noted that one or more (or all) of the steps of the community prize game (and thus, the community prize winnings round) may be performed on the community prize terminal (the output of which goes to the community prize screens 901), but may also or alternatively be performed on each eligible game terminal. For ease of illustration and discussion, the present examples discuss the operations to be performed on the community prize terminal 301. This is according to some embodiments and the present invention should not be so limited.

Step 301-3 initiates upon receipt of a "spin game" message from game server 201. The "spin game" message is initiated and was previously mentioned at step 201-11. The amount of predetermined random spins (as selected randomly as previously discussed at 201-3 and 201-12) has been met (e.g., the spin count has been decremented and is now zero as discussed previous in steps 201-7 through 201-10), and the game server triggers the community prize winnings round with a "spin game" message sent to the community prize terminal. The community prize terminal receives the message and then activates the community prize winnings round.

Step 301-4 may initiate upon successful completion of step 301-3. Community prize terminal 301 generates a result request message based upon the type of game it is configured to play (e.g., community bingo game, community slot game, community RNG-based game, community lottery game, etc.) in selecting one or more or all of the eligible players for the community prize. If this game is a community lottery game, game server 201 requests a ticket result from database 101. If the game is a community bingo game, the game server requests a bingo result. If it is a community RNG-based game, the game requests via SMIB board or connection to a secondary SAS port a random result from a central RNG service. Regardless, any game may be used to select a winner (or possibly no winner is resulted from the game) from the eligible players.

Step 301-5 may initiate upon successful completion of step 301-4. The community prize terminal 301 changes the game display from "attract mode" and "ready mode" to "play mode" (also known as "spin mode"), as illustrated in FIGS. 6A and 6B (601-1, 601-2, and 601-4, respectively). Prior to play mode, the community game will overlay a countdown on the community prize screen 901 showing when the community prize game is going to be played (shown in 601-3 of FIG. 6B). "Play mode" changes the game interface from standard display to a play display on all connected monitors, such as monitor 901 and the monitor associated by community prize terminal 301. Internally, the process awaits the return of a game result.

Step 301-6 may initiate upon successful completion of step 301-5. Game server 201 returns the game result to the community prize terminal. The game result is returned from step 201-15. The community prize terminal matches the prize result to a preconfigured set of results to determine what to display on the community prize terminal display. This result may correspond to who the winners are.

Steps 301-7 may initiate upon successful completion of step 301-6. Community prize terminal 301 activates the game logic and displays the defined result. The community prize terminal can display any type of game, such as a standard game (as is used as an example below). System 100 may display the community prize winnings round results in a three reel slot form, an example of which is illustrated at 601-5 in FIG. 6C. Based on the prize results, the community prize winnings round of the game-in-game will display either a winning or losing pattern by spinning each of the three reels, stopping them one at a time from left to right, until all three reels have displayed a symbol. The pattern generated by the three reel game will alert the players of a winner or a loser, as illustrated at 601-5 in FIG. 6C. Community prize screens 901 and other screens associated with community prize terminal 301 lists all game terminals that won the prize (i.e., the game terminals which were eligible to win because they were active when the community prize round was triggered).

Step 301-8 may initiate upon successful completion of step 301-7. The game-in-game functionality was triggered by a "spin game" message at step 301-1. Upon completion of all of the above processes for FIG. 3, a "game complete" message is sent to game server 201 from the community prize terminal completing the "spin" and returns the game-in-game to "ready" mode.

FIG. 4 illustrates on exemplary process implementing by game terminal 401 and community prize screen 901 to effectuate a community prize game. FIG. 4 occurs for each of the plurality of game terminals linked together by a network and all of such game terminals perform these steps (or at least some of these steps) simultaneously. It would be appropriate to say that the community prize game may be integrated in game terminal(s) 401 and the games themselves, as previously mentioned. The game configuration files may include the ability to allow the player to choose to participate and contain functions that both fund the community game prize set and alerts the player of their eligibility status in the game. Furthermore, the game terminal displays a congratulatory message to all winners and takes screen shots of all spins on the individual game terminal for audit purposes.

Referring to FIGS. 1 and 4, step 401-1 initiates upon a game-in-game activation message (e.g., an initiation message, such as a "Start Promotion" or promotion message as used herein) delivered from the game server 201 to each game terminal. The game server delivers configuration information to the game terminal via the game-in-game activation message. The game server delivers configuration parameters for any contribution fees for the game-in-game and an eligibility timer.

Step 401-2 may initiate upon successful completion of step 401-1. The game terminal sets the configuration parameters delivered at step 401-1, which includes defining any required credits or fees and the eligibility timeout for the player of the game terminal such that if the player does pay the required fees or credits or doesn't play the community prize game within the eligibility time (i.e., the eligibility timeout occurs), the player will not be eligible to win should the community winnings round be triggered (for that specific round).

Step 401-3 may initiate upon successful completion of step 401-2. The game-in-game has a unique player interface that may activate on top of the standard game interface when a player logs in. This is illustrated by 501-2 of FIG. 5 whereby the eligibility indicator and the count down timer are presented with the standard game (which in FIG. 5 is a five reel standard reel game). If configured in this manner, the player can choose to participate in the game-in-game by pressing a spin button (shown at 501-2 of FIG. 5 as the "Reveal" button) on the player interface or the system can simply require an enrollment.

The game-in-game graphic that is displayed will now be discussed. When a player presses the spin button (e.g., "Reveal" button) to spin the standard game (or other game), a countdown timer (also shown at 501-2 of FIG. 5) begins counting down from a preconfigured eligibility timeout value provide at step 401-2. In one embodiment, the spin button does not actually spin the reels when pressed a first time, and, in such embodiment, the player would need to press the spin button again to play the standard game and the community prize game. As the countdown timer counts down to zero, the spin button begins to change colors from green, to yellow, then to red (in that order) to visually show a countdown. If the player has not activated the spin button (and thus, not spun the reels) by the time the spin button turns red (or the timer has timed out) and the game-in-game function activates, the player is deemed ineligible and cannot regain eligible until the game-in-game completes processing and awards prizes if won (and if the community prize winnings round is triggered). When the player does press the spin button a second time and prior to the community timer timing out, the game-in-game activates, and a small "lock" symbol appears on the game terminal screen, and, if the game-in-game is in a locked position, the player knows they are eligible. If it is in "unlocked" position, then the player knows they are not eligible for any prizes during the community winnings round. The spin button may also provide all of the rules of the game and an explanation of how the game is played. Steps 100 also provide this functionality by utilizing pullout and dropdown panels and can be configured to display either player interface.

In another embodiment, the player plays the standard game without the game-in-game. A timer then starts and the player has to spin the standard game prior to the expiration of the timeout of the timer. If the player presses the spin button prior to the expiration of the timer, the player is not only playing in the standard game but also the game-in-game and is eligible to win during the community prize winnings round. As such, the player then only presses the spin button once to play both the standard game and the community prize (which are then play simultaneously) but only plays the standard game if the player presses the spin button after the timer times out.

In step 401-4, a player logs into a game terminal by entering a pin number, swiping a player magnetically-encoded card, inserting cash to a bill acceptor on a standalone game terminal or any other way to activate or associate some account or player with the game terminal.

Step 401-5 may initiate upon successful completion of step 401-4. Game terminals 401 and 901 access database 101 to determine if there are any required credits or fees to play the games (e.g., any credits or contribution fees required to play the community prize game, etc.). Separate processes may be required based on this setting. For example, if the fees to play the game-in-game are optional, the player may play the community prize game even though no fee has been entered, but the player won't be eligible to win any prizes. However, if the fees are required to play the game-in-game, the player may not be allowed to play the community prize game at all and thus can only play the standard game if the community timer times out without the player pressing the spin button. This is discussed in more depth below.

Step 401-6 initiates if the game participation fee or credit is optional as determined at step 401-5. The player may be prompted to "Participate in game-in-game by pressing button" by the user interface. If the player then does not press the spin button, the player just plays the standard game. Otherwise, the player is allowed to play the community prize game as further discussed below.

Step 401-7 initiates if the player chooses to participate in the game-in-game at step 401-6, or if the participation fee is require at step 401-5 and the player pressed the spin button prior to the community timer timing out. The player manually initiates the standard game by activating the appropriate button (e.g., the "Reveal" button or other button). An initiation request (including any participation credits or contribution fees) and game play request are transmitted to game server 201 for the game terminal processing. If required, these fees or credits are transferred from the account of the player (whether the account is a cash account on the game terminal or an account associated with the user's entered card) to the game server in order to play the game.

Step 401-8 may initiate upon successful completion of step 401-7. Game terminals 401 and 901 set the eligibility status to "eligible" upon the initiation of a standard game terminal spin. The players who did not submit an initiation request for the game-in-game (or who did not submit the requires fees or credits for the community prize game) are considered "not eligible," according to some embodiments. In some embodiments, those who are not eligible cannot be classified as winners and cannot win any prizes during the community winnings round.

Step 401-9 may initiate upon successful completion of step 401-8. A player must maintain at least one spin within the preconfigured eligibility timer settings or (s)he becomes ineligible for the game-in-game function. Step 401-7 automatically resets the eligibility community timer and initiates a new count down from a predetermined time. The timer may start a countdown in response to the player hitting the spin button to play the standard game, in response to the last standard game (or community prize game) completing, or any other predefined event.

Steps 401-10 initiates upon a timeout condition failure from step 401-9, wherein the timer has countdown to or below a predefined amount of time, such as "x" seconds. For example if the timer starts at 10 seconds (counting down to 0 seconds) and the timeout condition is that when the timer becomes 0 seconds, then the timeout condition has failed (i.e., the timer times out). The player is required to initiate a play (e.g., press the spin button) within a configurable timeout parameter to be eligible to win a community prize. If the player does not spin within the timeout period, the player's ineligibility status is saved at the server (or database), and the game terminal updates a community prize game control (illustrated at 501-2 in FIG. 5) to notify the player of his or her ineligibility by placing "ineligible" at the top of the control. The players who do not activate the community prize game (e.g., don't hit the spin button) by the time the community timer expires are not eligible and thus cannot either play in the community winnings round and/or cannot win a prize during the community winnings round.

It should be understood that each player may activate the community prize game via any method, such as by pressing the spin button, pressing some other button, or some other action indicating that the player wants to play the standard game or the game-in-game (or possibly an inaction). The use of a spin button is used for the examples presented herein only for ease of illustration and discussion.

Step 401-11 initiates upon a timeout condition from step 401-9 where the player presses the spin button prior to expiration of the community timer. The player manually initiates a spin by again pressing the spin button on the screen or button panel of a standard game, or the game-in-game automatically plays when the player presses the spin button the first time to play the standard game. As discussed below, after the spin button is pressed (after the player indicated he wants to play the community prize game), the reels start spinning (or the game is otherwise played) for the standard game and the standard game sends a "request play" request to the game server for the standard game to be being play and waits for a result from the game server (or the game terminal just plays the standard game). Any of the player's fees for the community prize may be included in the game play message according to an embodiment. In the Class III market, this message does not exist. A message with the player's contribution fees may be transmitted to a community prize server.

Step 401-12 initiates upon receipt of a "game play result" from the game server in response to a "game play" message sent at step 401-11. The "game play result" is generally part of the processing of a linked gaming system but does not exist in the Class III RNG markets. The game result indicates that all processing is complete for the standard game and the game results of the standard game are ready to be displayed to the player.

Step 401-13 initiates upon successful conclusion of step 401-12. The game receives a result from the game server and initiates a reel spin to display the results of the standard game to the player. Based on the message sent, the standard game assigns the symbols to each reel and stops the reels from left to right one at a time until one symbol is displayed for each and all of the reels. The resulting combination(s) of the displayed symbols of the reels are compared with predetermined combinations of the symbols (stored in a database prior to the game being played by the manufacturer or other entity) to determine if the resulting spin produces a prize for the standard game. If there is a match of the resulting symbols on the screen and any of the predetermined combinations of symbols, then a prize is won for the standard game. If a prize is won, then the game increments the user's account and thus, money (or prizes) is given to the player for winning the standard game. In the Class III market, the game will execute an RNG to determine the reel stops and which symbols are displayed. Thus, steps 401-11 through 401-13 are the player playing the standard game.

Step 401-14 initiates when a spin request for the standard game was received from the game server. When the player plays the standard game as discussed above, the spin request would be received from the game server, thereby providing the game server an indication that the player has initiated playing the standard game and thus is a trigger to the server to play the community prize game for those eligible (and for those ineligible according to some embodiments). Step 401-14 runs asynchronously with the standard game, and the game terminal listens for a "community prize spin" message from the game server which is a message generated when the community prize winnings round has been triggered. This "community prize spin" message is presented when it is time to give out a community prize as previously discussed with regard to FIGS. 2-3. If a "community prize spin" message is not received from the game server, then the system waits for the next spin by the player and the method returns to step 401-7; otherwise, when the game terminal receives the "community prize spin" message, the method continues to 401-15 discussed below.

Step 401-15 initiates upon receipt of a "community prize spin" message from step 401-14. As discussed above with regard to 201-3, the "community prize spin" message is generated at random and the community prize winnings round is initiated when the community prize spin message is received. In response to receipt of such message, the game terminal checks to see if the player is eligible or ineligible for the community prize as explained above with respect to steps 401-8, 401-10 and 401-11. If the player is ineligible, the "community prize game control" (illustrated at 501-2 in FIG. 5) displays a graphic that indicates the player is ineligible for the duration of the community prize winnings round (which may be a single spin of the community prize reel). If the player is eligible, the player can win prizes during the community prize winnings round.

Step 401-16 may initiate upon successful completion of step 401-15. The game terminal sends a "status message" to the game server synching up the eligibility status between the game terminal and the server. This may be the server sending requests to all game terminals to request their eligibility status (or retrieving this previously stored information on the database or in memory of the server). Once the game terminals have synchronized the eligibility status with the game server, player eligibilities with the game server the community prize process occurs in which is explained above with respect to FIG. 3.

The community prize winnings round is performed. In this regard, a community game is run to determine who the winners are. This may be by a game, a lottery selection, a determination all eligible players are winners, or any other method. If a game or lottery selection is played, the results of the game are displayed on the community prize screen and a list of winners is returned to the server. The processes regarding the community prize winnings round is discussed above with regard to FIG. 3.

Step 401-17 initiates upon receipt of a "winners list" message from the game server. The game parses the winners list to determine if a prize has been awarded to the player on the game terminal.

Step 401-18 may initiate upon successful completion of step 401-16. Upon determination that the player is a winner at step 401-17, the game terminal determines what state the standard game is in. The system reacts differently if the game is in a free spin, bonus round, or pick'em round than it does if the game is in a normal play mode. For example, the standard game could be in a free spin or a bonus round and may still be played while the communing winnings round is played and/or completed. As such, the game terminal is notified of the player winning from the community prize winnings round while the player is still playing in the standard game, as is discussed below with regard to 401-19.

Step 401-19 initiates upon determination at step 401-18 that the game state is in a free spin, bonus, or pick'em round. The game terminal updates the "community prize game control" (501-2 at FIG. 5) to display "winner" to alert the player that (s)he has a won while it completes the bonus rounds or other portion of the standard game.

Step 401-20 initiates upon determination that the game state is not in a free spin, bonus round, pick'em round or other portion of the standard game, and/or upon successful completion of step 401-19. This is illustrated in FIG. 6C. The game overlays a winner pop-up screen over the top of the main game screen to alert the player that (s)he is a winner in the community prize round. The game will also "roll up the game meters" (i.e., increment the player's account or provide the player winnings or prizes) as part of the notification of the win. The player then presses "OK" on the winner's screen to acknowledge the win.

Step 401-21 initiates upon the player choosing not to contribute any credits or fees for the community prize system at step 401-6. If the system is configured to allow a choice to contribute fees/credits or not to join the community prize game, then a player has an option to join or to pass. If a player chooses to pass, then the system simply processes normal game play, marking the player as ineligible for the community prize. If a player decides to end the session and is not participating in the community prize, then the session may terminate.

Step 401-22 may initiate upon successful completion of step 401-20. The player at this point has an option to end the game session by selecting cash out (to distribute the player's money's in the player's account to the player or player's card) or simply log out on the game interface. If the player chooses to continue to play, (s)he simply presses the "play" button on the player interface and initiates step 401-5. If the player chooses to end the game session by pressing cash out or logout, then the game terminal session terminates and the attract mode screen (601-1 of FIG. 6A) initiates.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. For example, aspects of one embodiment may be combined with aspects of other embodiments to yield still further embodiments. Therefore, it is contemplated that any and all such embodiments are included in the present invention as may fall within the scope and spirit thereof.

What is claimed is:

1. A computer-implemented method, comprising:

a. providing a plurality of gaming terminals linked together via a network, the plurality of gaming terminals comprising at least a first gaming terminal;

b. receiving a first request from a first player to play a first sweepstakes game on the first gaming terminal, wherein the first request qualifies the first player to be eligible to win an award associated with the first sweepstakes game;

c. in response to receiving the first request:

i. receiving a participation credit to play the first sweepstakes game;

ii. presenting an option to the first player to participate in a first sweepstakes game-in-game on the first gaming terminal so that the first player can play the first sweepstakes game and concurrently be eligible to win one or more prizes from the first sweepstakes game-in-game, wherein an outcome of the first sweepstakes game-in-game is independent of the outcome of the first sweepstakes game;

iii. receiving a second request; and iv. in response to receiving the second request within a predetermined time limit, granting the first player eligibility to win one or more prizes from the first sweepstakes game-in-game;

d. triggering a play of the first sweepstakes game-in-game; and e. notifying the first player of their eligibility to win one or more prizes from the play of the first sweepstakes game-in-game, wherein once the second sweepstakes game-in-game is triggered to play, the second sweepstakes game-in-game automatically plays on a server without input from the first gaming terminal.

2. The computer-implemented method of claim 1 further comprising in response to receiving the second request outside the predetermined time limit, determining that the first player is not eligible to win one or more prizes associated with the first sweepstakes game-in-game.

3. The computer-implemented method of claim 1, wherein the first request comprises receiving a first predetermined action from the first player, wherein the first predetermined action relates to the first player playing or requesting to play the first sweepstakes game.

4. The computer-implemented method of claim 3, wherein the first predetermined action comprises the first player activating a button presented on a screen of the first gaming terminal.

5. The computer-implemented method of claim 4 wherein the second request comprises receiving a second predetermined action from the first player during a countdown of a timer, wherein the second predetermined action relates to the first player playing or requesting to play the first sweepstakes game.

6. The computer-implemented method of claim 5, wherein the second predetermined action comprises the first player activating the button presented on the screen of the first gaming terminal.

7. The computer-implemented method of claim 1, wherein the first request further comprises logging in the first player to the first game terminal.

8. The computer-implemented method of claim 1 further comprising a. submitting a first participation credit for the first sweepstakes game in response to submitting the first initiation sweepstakes game request such that the first participation credit is debited from an account associated with the player, and b. submitting a second participation credit for the first sweepstakes game-in-game if the first sweepstakes game request is submitted prior to the timer timing out such that a second participation credit is debited from the account associated with the first player.

9. A computer-implemented method comprising:

a. providing a first player of a plurality of players with access to a first game terminal, wherein the first game terminal is networked to other game terminals;

b. presenting a timer to the first player;

c. receiving a first sweepstakes game request for a first sweepstakes game to be played on the first game terminal;

d. receiving a participation credit for at least the first sweepstakes game at least partially in response to the first player submitting the first sweepstakes game request;

e. triggering play of a first sweepstakes game-in-game on a first sweepstakes game-in-game terminal;

f. performing a step selected from a group consisting of:

i. determining that the first player is not eligible to win an award associated with the first sweepstakes game-in-game if the first sweepstakes game request was not submitted prior to the timer timing out; and ii. determining that the first player is eligible to win an award associated with the first sweepstakes game-in-game if the first sweepstakes game request was submitted prior to the timer timing out;

g. wherein the first sweepstakes game-in-game terminal i. requests a play result from a name server; and ii. matches the result to a pattern that will be displayed on a first sweepstakes game-in-game display.

10. The computer-implemented method of claim 9 wherein the first sweepstakes game request comprises activating a button on the first gaming terminal.

11. The computer-implemented method of claim 10 further comprising triggering play of the first sweepstakes game-in-game when the first sweepstakes game request is submitted.

12. The computer-implemented method of claim 9 further comprising a. allowing a second player to access a second gaming terminal, wherein the second gaming terminal is networked to the first gaming terminal;

b. presenting a second timer to the second player;

c. receiving a second sweepstakes game request for a second sweepstakes game;

d. performing a step selected from a group consisting of:

i. determining that the second player is not eligible to win an award associated with the first sweepstakes game-in-game if the second sweepstakes game request was not submitted prior to the second timer timing out; and ii. determining that the second player is eligible to win an award associated with the first sweepstakes game-in-game if the second sweepstakes game request was submitted prior to the second timer timing out;

e. wherein i. an outcome of the first sweepstakes game-in-game is independent of the outcome of the second sweepstakes game, and ii. play of the first sweepstakes game-in-game is concurrent with at least one play of the second sweepstakes game.

13. The computer-implemented method of claim 12, wherein the second sweepstakes game request comprises the second player activating a button presented on a screen of the second gaming terminal.

14. A system comprising:

a. a computer hardware processor of a first game terminal, wherein the first game terminal is connected to a plurality of game terminals over a network, and wherein the plurality of game terminals are played by a plurality of players, the processor configured to perform a method using computer instructions from a non-transitory computer readable medium, the method comprising:

b. receiving a first sweepstakes game request for a first sweepstakes game to be played on the first game terminal;

c. receiving a first player participation credit for the first sweepstakes game;

d. presenting a timer to the first player and starting said timer in response to the receiving the first sweepstakes game request;

e. prior to the timer timing out and in response to the receiving a the first sweepstakes game request, determining if the first player performs a predetermined action indicating that the first player wishes to participate in a first sweepstakes game-in-game;

f. triggering play of a first sweepstakes game-in-game;

g. performing a step selected from a group consisting of:

determining that the first player is not eligible to win an award associated with the first sweepstakes game-in-game if the predetermined action was not performed prior to the timer timing out; and determining that the first player is eligible to win an award associated with the first sweepstakes game-in-game if the predetermined action was performed prior to the timer timing out;

wherein once the first sweepstakes game-in-game is triggered to play, i. a server conducts all play of the first sweepstakes game-in-game without input from the plurality of game terminals for each play of the first sweepstakes game-in-game; and ii. the server selects a first sweepstakes game-in-game result from memory; and iii. the server facilitates selection of a predetermined pattern that is associated with the selected result.

15. The system of claim 14, wherein:

a. the first participation credit is debited from an account associated with the first player, and;

b. a second participation credit is debited from the account of the first player if the predetermined action was performed prior to the timer timing out.

16. The system of claim 14, further comprising:

a. a computer hardware processor of a second game terminal of the plurality of game terminals, the computer hardware processor of the second game terminal configured to perform a second method comprising:

b. receiving a second sweepstakes game request for a second sweepstakes game to be played on the second game terminal;

c. presenting a second timer to the second player and starting the second timer in response to receiving the second sweepstakes game request;

d. prior to the second timer timing out and in response to the receiving the second sweepstakes game request, determining if the second player performs a second predetermined action indicating that the second player wishes to participate in the first sweepstakes game-in-game;

e. performing a step selected from a group consisting of:

determining that the second player is not eligible to win an award associated with the first sweepstakes game-in-game if the second predetermined action is not performed prior to the timer timing out; and determining that the second player is eligible to win an award associated with the first sweepstakes game-in-game if the second predetermined action is performed prior to the timer timing out.

17. The system of claim 16, wherein the second method further comprises:

a. submitting a first participation credit by the second player, the first participation credit being submitted for the second sweepstakes game in response to submitting the second sweepstakes game request such that the second player first participation credit is debited from an account associated with the second player, b. wherein the predetermined action comprises submitting a request to play the second sweepstakes game prior to the timer timing out such that the second player first participation credit is debited from the account of the second player.

18. A computer-implemented method comprising:

a. allowing a first player to access a first game terminal, wherein the first game terminal is networked to other game terminals;

b. receiving a first sweepstakes game request for a first sweepstakes game to be played on the first game terminal;

c. receiving a participation credit from the first player;

d. determining if the first player performs a predetermined action indicating that the first player wishes to participate in a first sweepstakes game-in-game;

e. in response to determining if the first player performs the predetermined action, performing a step selected from a group consisting of:

i. determining that the first player is not eligible to win the first sweepstakes game-in-game if the predetermined action was not performed in accordance with a first criterion; and ii. determining that the first player is eligible to win the first sweepstakes game-in-game if the predetermined action was performed in accordance with the first criterion;

f. triggering play of the first sweepstakes game-in-game, wherein once the first sweepstakes game-in-game is triggered to play, a first game-in-game terminal facilitates all play of the first sweepstakes game-in-game without input from the plurality of game terminals.

19. The computer-implemented method of claim 18 wherein the first sweepstakes game and the first sweepstakes game-in-game play simultaneously.

20. The computer-implemented method of claim 18 further comprising presenting and starting a timer in response to receiving the first sweepstakes game request.

21. The computer-implemented method of claim 20 wherein the first criterion comprises performing the predetermined action before the timer times out.

22. The computer-implemented method of claim 21, wherein receiving the first sweepstakes game request for the first sweepstakes game to be played on the first game terminal comprises receiving an indication that the first player on the first game terminal activated a button.

23. The computer-implemented method of claim 18, wherein the first sweepstakes game request further comprises logging on to the first game terminal.

24. The computer-implemented method of claim 18 further comprising:

a. collecting a second participation credit from the first player for the first sweepstakes game-in-game if the first player performs the predetermined action prior to the timer timing out; and b. associating a portion of the second participation credit toward an award for the first sweepstakes game-in-game to be distributed to all players that are eligible to win the first sweepstakes game-in-game if the player performs the predetermined action prior to the timer timing out.

25. The computer-implemented method of claim 18 further comprising a. receiving a second sweepstakes game request for a second sweepstakes game to be played by a second player on a second game terminal, wherein the plurality of game terminals comprises the second game terminal;

b. determining if the second player performs a second predetermined action within a predetermined time limit indicating that the second player wishes to participate in the first sweepstakes game-in-game;

c. in response to second player performing the predetermined action within the predetermined time limit, determining that the second player is eligible to participate in the first game-in-game such that a winner of the first sweepstakes game-in-game can be selected from the first and second players.

* * * * *

UNITED STATES PATENT AND TRADEMARK OFFICE

CERTIFICATE OF CORRECTION

PATENT NO. : 8,545,315 B2
APPLICATION NO. : 13/424630
DATED : October 1, 2013
INVENTOR(S) : Bob Mosley et al.

It is certified that error appears in the above-identified patent and that said Letters Patent is hereby corrected as shown below:

In the claims:
Column 21, line 37 (claim 9, line 25) please change “a name” to -- a game -- therefor.
Column 22, line 25 (claim 14, line 18) please change “receiving a the” to -- receiving the -- therefor.

Signed and Sealed this
Twenty-sixth Day of November, 2013

Margaret A. Focarino

Margaret A. Focarino
*Commissioner for Patents of the United States Patent and Trademark Office*